US005285919A

United States Patent [19]

Recchia

[11] Patent Number: 5,285,919

[45] Date of Patent: Feb. 15, 1994

[54] BEVERAGE CONTAINER WITH AIR ACCESS FOR DIRECT DRINKING

[76] Inventor: Donald Recchia, 128 S. Hillside Ave., Succasunna, N.J. 07876

[21] Appl. No.: 998,388

[22] Filed: Dec. 30, 1992

[51] Int. Cl.[5] ..... B65D 17/34

[52] U.S. Cl. ..... 220/271; 220/269

[58] Field of Search ..... 220/268, 269, 270, 271

[56] References Cited

U.S. PATENT DOCUMENTS

| | | | |
|---|---|---|---|
| 3,441,169 | 4/1969 | Dunn et al. | 220/271 |
| 3,970,212 | 7/1976 | Brown | 220/269 |
| 4,094,435 | 6/1978 | Kennedy | 220/269 |
| 4,196,823 | 4/1980 | Madden et al. | 220/268 |
| 4,205,760 | 6/1980 | Hasegawa | 220/271 |
| 4,572,398 | 2/1986 | Juty | 220/271 |
| 4,576,306 | 3/1986 | Kelsey et al. | 220/271 |
| 5,011,037 | 4/1991 | Moen et al. | 220/271 |

*Primary Examiner*—Allan N. Shoap
*Assistant Examiner*—Stephen Cronin
*Attorney, Agent, or Firm*—Israel Nissenbaum

[57] ABSTRACT

Drinking access to the contents of a beverage container, having a non-removable opening lift tab, is enhanced by the formation of an air access opening in the container adjacent the beverage access opening. The beverage container top has a first scored section which is opened by the lift tab for access to the contained beverage. The beverage container top further includes a second scored section diametrically opposed to the first scored section which is opened by the same lift tab. The lift tab is swiveled and used to open the second scored section to provide the requisite air access opening, if drinking directly from the container is desired. The lift tab can be rotated to the side of the openings, if desired, to eliminate impedance of direct drinking from the container. The second scored section is sized to permit sufficient air to enter the container to cause the beverage contained in the container to flow in a strong steady stream when the opened first scored section is sealed from the air by the drinker's mouth during drinking.

5 Claims, 3 Drawing Sheets

BEVERAGE CONTAINER WITH AIR ACCESS FOR DIRECT DRINKING

FIELD OF THE INVENTION

This invention relates to opening of metal beverage containers and particularly to single serving containers having non-removable fulcrum type lift tabs which open the container for direct drinking therefrom.

BACKGROUND OF THE INVENTION

Single serving metal beverage containers such as soda or beer cans are currently marketed with self contained openers in the form of lift tabs. In all of the present embodiments, the lift tab is comprised of a ring-like lift portion for control by an inserted finger. In one form of lift tab, the ring is attached to a pear shaped pre-scored section of the container top, with continued lifting of the ring causing a relatively large pear shaped section to become completely detached from the container top. This type of lift tab has however met with an environmental outcry since it has resulted in a new type of litter. Accordingly, a more acceptable non-detachable lift tab is presently being utilized on nearly all of the soda and beer cans currently sold in the United States, with the soda and beer cans being themselves recycled to reduce litter.

However, unlike the containers with removable tabs which provided large openings and thereby permitted relatively easy drinking directly from the container, the non-detachable lift tabs impede direct drinking. The opening made with the non-detachable lift tab is, of necessity, relatively small and close to the rim of the container. Direct drinking results in the entire opening being covered by the mouth, thereby causing the contained beverage to flow out in a trickle rather than a strong flow. In addition, the tab itself obstructs drinking access to the opening. As a result, drinking from the container is in the form of a less than satisfying dribble. To obviate these disadvantages, the drink is either poured into a second container such as a cup, or straws are inserted into the opening.

The non-detachable lift tab, with some design variations, is basically comprised of a short, somewhat rectangular, elongated aluminum strip (about $1\frac{1}{8}\times\frac{5}{8}$inch—28×16 mm) with rolled over edges for structural strength and for prevention of exposed sharp edges. At a first end, the tab is formed into a ring-like member (also with rolled over inner edges) for finger insertion and lifting. The second end, with strengthened rolled over edge, is rounded or tapered and centrally crimped for force-concentrated pushing engagement with a cantilevered weakened section of the container top, which will open upon continued application of force.

To facilitate manufacture and container storage nesting, the usually circular container top is shallowly dished along a major portion of a diameter thereof. About half of the length of the dished area is formed for seated mating with the lift tab, i.e., slightly larger but conformed to the peripheral shape of the lifting end and adjacent sides of the lifting tab. The center of the container top, situated within the dished area, is formed with an integral outwardly extending hollow rivet-like section which fits into a corresponding aperture located on the longitudinal axis of the tab. The aperture is positioned on the tab such that the engagement between tab and container top results in about three quarters of the length of the tab (the lifting end) being situated on one side of the engagement site and about one quarter of the tab (the pushing end) being situated on the other side. The rivet-like section is then peened over, during assembly, to fixedly attach the lift tab to the container top.

The remaining dished area in the container top contains a peninsularly shaped weakening score line such as in the shape of a thumb nail (other similar design related shapes include truncated ovals or circles) having its tapered (or arced) end extending in a direction away from the tab. A small portion of the "thumb nail", peripherally adjacent to the engagement site, however remains unscored. The pushing end of the tab extends over the non-scored portion and over the adjacent area enclosed by the thumb nail score line. During the opening operation, the lifting end of the tab is elevated. The tab pivots through the rivet engagement area and the pushing end of the tab swivels down thereby tearing the scored section and pushing the weakened area of the container top into the container. Because of its proximity to the pushing end of the tab, the scored area, adjacent the rivet-like section, tears open first, with initial internal gas pressure relief (the contained beverages are usually carbonated or are susceptible to internal gas evolution).

Upon continued pushing force, the tear propagates around the score line away from the pushing end of the tab. The section of the container top, enclosed by the score line, then pivots down into the container in a cantilevered movement, and is held from falling into the container by the small unscored section of the "thumb nail". The area surrounding the contact point between the tab end and the container top is strengthened by a raised rib integrally formed within the "thumb nail" area to prevent gouging of the container top by the tab end.

Several embodiments of prior art containers include frangible buttons or sections of the container which are initially pressed either with a finger or by depression of the tab with a finger. These buttons or frangible sections pop to provide initial pressure relief for facilitated opening of the container. However, in order for such buttons or frangible sections to be effectively opened by finger pressure, a portion of a pressurized container must be overly weakened. The weakened section is, however small, to avoid undue weakening of the container, and since only a small opening is required for pressure relief.

Inclusion of the pressure relief sections, requires expensive modification of existing machinery for producing beverage cans, to form the can tops with integral buttons or frangible sections. Manufacturers are accordingly very reluctant to effect such modifications, particularly since the necessity for the initial pressure relief has been substantially obviated by use of the container-opening lift tabs, which, upon initial use, allow for the pressure relief.

Most detrimentally, such buttons or frangible sections operate with the tab being depressed against the button or frangible area. This depression often occurs simply upon handling of the containers and the buttons or frangible sections are readily accidentally activated during handling of the containers. For these reasons their use has been avoided.

SUMMARY OF THE INVENTION

It is an object of the present invention to provide an economical modification to a container top which will allow for the facilitated direct beverage imbibing from the container.

It is a further object of the present invention to provide such facilitated imbibing by means of a non-accidental prone use of the container-opening lift tab with relatively high concentrated tearing forces, whereby the can does not need to be overly weakened.

It is a still further object of the present invention to provide a sufficiently large opening for air ingress to the container to improve the rate of liquid removal from the container.

These and other objects, features, and advantages of the present invention will become more evident from the following discussion and drawings in which:

SHORT DESCRIPTION OF THE DRAWINGS

Figure 2:
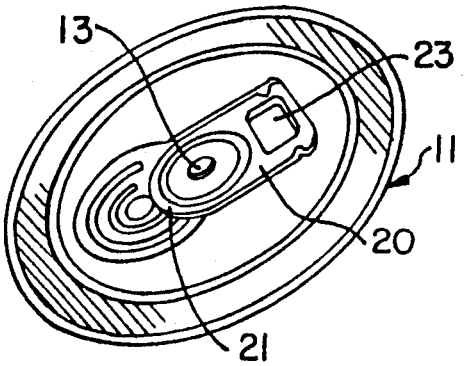
FIG. 2 is the beverage container top of FIG. 1 with attached lift tab.
Figure 3A:
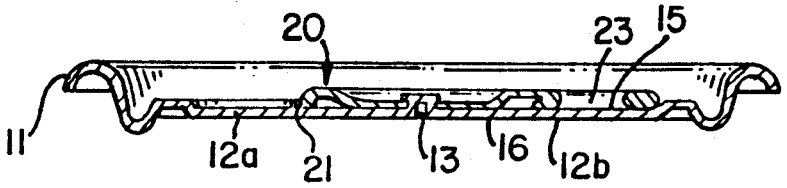
Figure 3B:
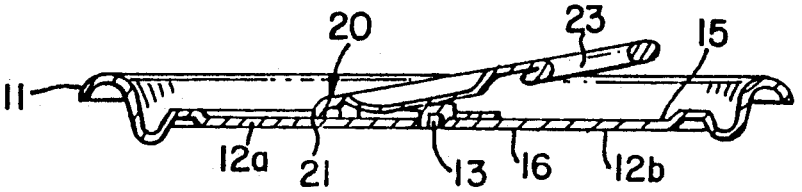
Figure 3C:
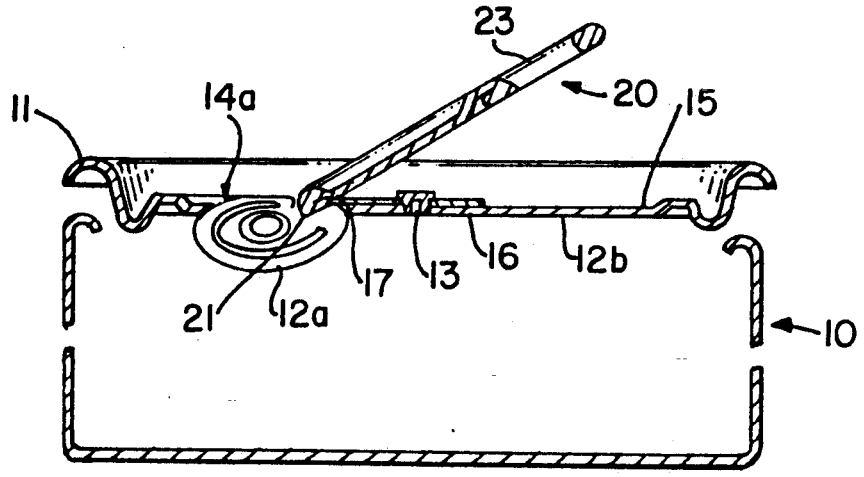
Figure 4:
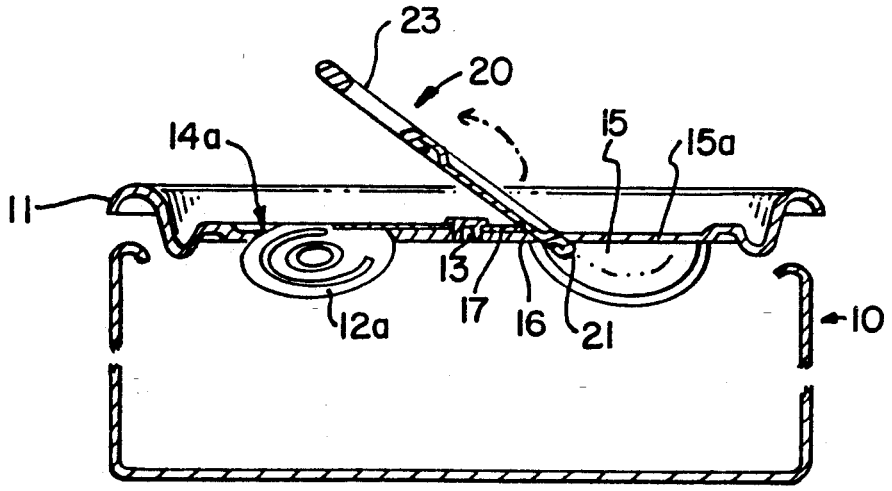
Figure 5A:
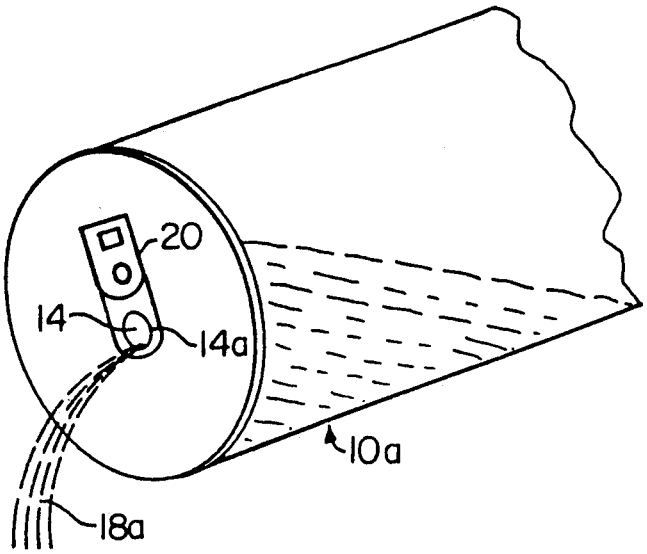
Figure 5B:
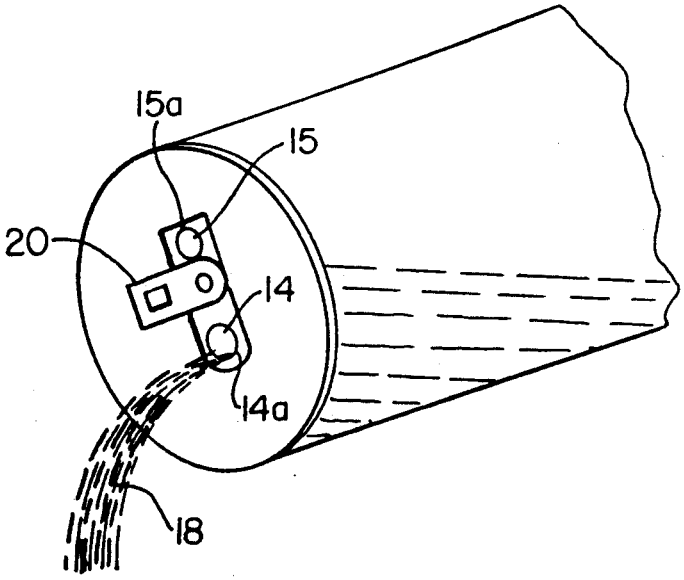

FIGS. 3*a–c* depict a side section sequential view of the container with the top of FIG. 2 being opened for beverage access;

FIG. 4 is a side view of the beverage container of FIGS. 3*a–c* with the lift tab moved into position for forming of the air access opening and opening formation; and FIGS. 5*a–b* are comparative side cross section views of a container of the prior art and that of the present invention showing the relative rates of pouring of contained liquids.

DETAILED DESCRIPTION OF THE INVENTION

Generally the present invention comprises a beverage container having a top adapted for use with a non-detachable fulcrum type lifting tab, which forms an opening in the container top for pouring-out access of the container contents. The container top comprises means for forming two separated openings therein, with formation of a first opening, providing for access to the container contents, and formation of a second opening, providing for air access to the interior of the container to facilitate pouring-out access of the container contents. Each of the openings is formed by a lifting of the tab.

In a preferred embodiment, the container top comprises a centrally located, integrally formed rivet member. The lifting tab is affixed to the container top by the rivet, with the lifting tab being swivelable about the rivet connection. The two separated openings comprise two separate peninsularly shaped scored sections of the container top adjacent to and spaced from the rivet and extending therefrom. The swivelable tab, held by the rivet, is able to separately engage each scored section with a pushing end thereof.

The scored sections are located in the dished section of the container top, as described above, which dished section passes through the center of the container top. The lifting tab is attached to a peened over rivet integrally formed at the center of the container top and the middle of the dished section. The scored sections are diametrically opposed along the axis passing through the rivet and which defines the activating position of the lifting tab and are positioned such that the lift tab can be swivelled to open either or both of the first and second scored sections. The opening of the scored sections requires a positive lifting of the lift tab with fulcrum opening, and accordingly such sections cannot be accidentally opened. In addition, the lifting tab and the concomitant fulcruming forces allow for the opening of a large area of the container top for sufficient air access to the container interior to facilitate strong even flow of the contained beverage even when the other opened section is completely sealed from the air such as by a drinker's mouth.

DETAILED DESCRIPTION OF THE DRAWINGS AND THE PREFERRED EMBODIMENT

Figure 1:
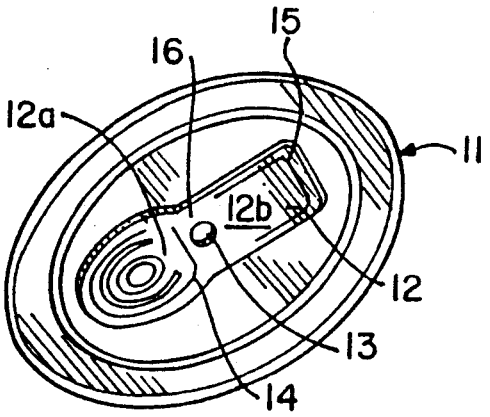
FIG. 1 is a top view of a typical beverage container top with the lift tab removed.

With specific reference to the drawings, in FIG. 1 a typical can top 11 is shown with a central integrally formed rivet 13. Dished section 12 which accommodates lift tab 20 is comprised of thumb shaped section **12*a* and rectangular section 12*b*. The thumb shaped section 12*a* is provided with score line 14 which is opened by lifting of tab 20** (more clearly shown in FIGS. 3*a–c*) for access to the can contents such as soda. Score line 15, diametrically opposed to score line 14 and on the other side of rivet 13, is also opened by lifting of tab 20, for opening of an air access hole.

FIG. 2 shows the can top 11 with placement of tab 20, which is held in place by peened over rivet 13. Peened over rivet 13, as further shown in sequential FIG. 3*a–3c*, holds a portion of tab 20 while it is lifted to cause an end 21 thereof to apply pressure to the can top area bounded by score line 14 to form drink access opening **14*a***.

The can 10, shown in FIG. 3*c*, is in the configuration for standard drinking. As shown in FIG. 4, the partially lifted tab 20 is swiveled around the axis afforded by the rivet 13 with tab end 21 being positioned over rectangular dished section **12*b*. In accordance with the present invention, the dished section 12*b* is inscribed with score line 15 in a thumb nail configuration, similar to but slightly smaller than that of score line 14. Lifting of the tab 20 causes score line 15 to open to provide air access through air access aperture 15*a*. Bridge section 16 between the drink access opening 14*a* and air access aperture 15*a* should be of sufficient width to support the tab 20 with tab end 21 to effect opening of score line 15. In addition, tab connecting section 17 which connects tab pushing end 21 and rivet 13 should be capable of the dual pressing use without breakage. As shown by the dotted lines, tab 20, having elevated finger grip 23, is rotated 90° to the side to move it out of the way for direct drinking from can 10**.

FIGS. 5*a* and 5*b* illustrate the difference in liquid flow between the single aperture cans of the prior art and the dual aperture cans of the present invention. In FIG. 5*a*, a prior art container **10*a* is shown with a fluid trickle 18*a*** because of the build up of a partial vacuum within the container with the dispensing of the contents. As shown in FIG. 5*b*, the air access through aperture **15*a* permits equalization of pressure thereby resulting in the steady flow 18** of the fluid container contents.

It is understood that the above description and drawings are illustrative of the present invention and that changes may be made to the container structure, components and relative elements, as well as aperture size, configuration, and placement and the like, without departing from the scope of the present invention as defined in the following claims.

What is claimed is:

1. A beverage container having a top with a non-detachable fulcrum type lifting tab, having a pushing end and a lifting end, attached thereto, said lifting tab being adapted to form an opening in the container top for pouring-out access of the container contents; the container top comprising means for forming two separated openings therein, with formation of a first opening, providing for access to the container contents, and formation of a second opening, providing for air access to the interior of the container to facilitate said pouring-out access of the container contents; and wherein each of said openings is formed by a lifting of the lifting end of said tab; wherein said container top comprises a centrally located, integrally formed rivet member, said lifting tab being affixed to the container top by said rivet with the lifting end positioned on one side of the rivet and the pushing end positioned on the other side of the rivet and the lifting tab being swivelable about the rivet; the means for forming the two separated openings comprising two separate planar peninsularly shaped scored sections of the container top adjacent to and spaced from the rivet and extending therefrom, the swivelable tab held by the rivet is able to separately engage each of said scored sections with the pushing end thereof, so that lifting of the lifting end of the tab causes the pushing end of the tab to apply pressure to one of said two scored sections, causing said section to separate from the remainder of the container top, thereby forming the respective openings.

2. The beverage container of claim 1, wherein the container top comprises an elongated inwardly dished section which passes through the center of the container top, with the rivet being located within said dished section and, wherein a portion of the dished section on one side of the rivet is scored in a direction away from the rivet to form a first of said peninsularly shaped sections and wherein a second portion of the dished section, on the opposite side of the rivet, is scored in a direction away from the rivet to form the other of said peninsularly shaped sections.

3. The beverage container of claim 2, wherein each of the peninsularly shaped sections respectively circumscribes a substantial portion of the dished section on the respective sides of the rivet whereby the respective openings comprise a substantial portion of the dished section.

4. The beverage container of claim 3, wherein an area between the respective peninsularly shaped sections is of sufficient width to provides a support for the rivet and a support for the lift tab to effect formation of the air access opening after formation of the first opening for access to the container contents.

5. The beverage container of claim 4, wherein the connection between the tab and the rivet is of sufficient strength to enable the lift tab to effect formation of the air access opening after formation of the first opening for access to the container contents.

* * * * *